US006210240B1

(12) United States Patent
Comerci et al.

(10) Patent No.: US 6,210,240 B1
(45) Date of Patent: Apr. 3, 2001

(54) ELECTRICAL CONNECTOR WITH IMPROVED TERMINAL

(75) Inventors: Joseph D. Comerci, Elmhurst; Kenneth K. Kotz, Cary; Michael Mayo, Lockport, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/628,055

(22) Filed: Jul. 28, 2000

(51) Int. Cl.[7] ..... H01R 11/22
(52) U.S. Cl. ..... 439/853; 439/947
(58) Field of Search ..... 439/682, 947, 439/853, 857, 852, 510

(56) References Cited

U.S. PATENT DOCUMENTS

| | | | | |
|---|---|---|---|---|
| 4,029,377 | | 6/1977 | Guglielmi | 339/19 |
| 4,379,611 | | 4/1983 | Foege et al. | 339/217 |
| 4,557,548 | * | 12/1985 | Thrush | 439/842 |
| 4,790,764 | * | 12/1988 | Kawaguchi et al. | 439/78 |
| 5,421,751 | | 6/1995 | Bennett et al. | 439/843 |
| 5,431,576 | | 7/1995 | Matthews | 439/247 |
| 5,545,943 | | 8/1996 | Arvidsson et al. | 174/35 |
| 5,630,720 | * | 5/1997 | Kocher | 439/947 |
| 5,647,748 | | 7/1997 | Mills et al. | 439/81 |
| 5,807,120 | | 9/1998 | Matthews | 439/80 |
| 5,842,876 | * | 12/1998 | Collin et al. | 439/947 |

* cited by examiner

*Primary Examiner*—Paula Bradley
*Assistant Examiner*—Tho D. Ta
(74) *Attorney, Agent, or Firm*—Stephen Z. Weiss

(57) ABSTRACT

An electrical connector is mateable with a complementary connecting device having a blade terminal. The connector includes a dielectric housing having a front mating face, an elongated terminal-receiving cavity with an open end through the mating face for insertion therethrough of the blade terminal, and a locking ledge on an end wall of the cavity. A conductive female terminal is received in the cavity and includes a pair of elongated side walls joined in spaced relation by at least one end wall. A plurality of flexible contact arms are folded back over each side wall from an upper edge thereof for engaging a respective side of the blade terminal. A locking finger projects from the end wall of the terminal and is engageable with the locking ledge on the end wall of the terminal-receiving cavity.

12 Claims, 3 Drawing Sheets

ELECTRICAL CONNECTOR WITH IMPROVED TERMINAL

FIELD OF THE INVENTION

This invention generally relates to the art of electrical connectors and, particularly, to an electrical connector having an improved terminal, such as a power terminal for mating with a blade terminal.

BACKGROUND OF THE INVENTION

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The interengaging terminals of the connectors, themselves, may be male and female terminals.

One type of electrical connector is a power connector which mounts one or more power terminals. One type of power terminal, as shown in FIG. 6a and 6b as opposed terminals, is a female terminal adapted for receiving and engaging a power terminal blade of a complementary mating connector or other connecting device. The female terminal is configured for engaging both opposite sides of the power terminal blade. Heretofore, typical female terminals of this type included a redundant pair of contact walls on opposite sides of the terminal blade, each wall having a plurality of bent contact arms for engaging a respective side of the terminal blade. For instance, the contact arms may be bent back from a top edge of the contact wall. The opposite edge of the contact wall is located at a terminating face of the connector and may include a plurality of tail portions for insertion into appropriate holes in a printed circuit board, for instance.

One problem with prior art connectors as described above is that the terminals include a pair of separate contact portions on opposite sides of the power terminal blade. If one of the contact portions is not fully inserted into the connector housing or is not inserted at all, the other contact portion still may pass an electrical continuity inspection but will result in a lower current carrying capacity since both contact portions are required for an effective electrical engagement. Other problems with such two-part female terminals for receiving terminal blades involves the latch in the base which will reduce current flow, will not allow for a close side by side placement of the terminals, and will not provide a precise location and a stable engagement in the housing. The present invention is directed to solving these various problems and providing an efficient connector having an improved female terminal of the character described.

SUMMARY OF THE INVENTION

An object, therefore, of the invention is to provide a new and improved electrical connector for mating with a complementary connecting device having a blade terminal.

Another object of the invention is to provide a new and improved female terminal for receiving and engaging the blade terminal.

In the exemplary embodiment of the invention, an electrical connector is shown to include a dielectric housing having a front mating face, an elongated terminal-receiving cavity with an open end through the mating face for insertion therethrough of the blade terminal, and a locking ledge on an end wall of the cavity. A conductive female terminal is received in the cavity and includes a pair of elongated side walls joined in spaced relation by at least one end wall. A plurality of flexible contact arms are folded back over each side wall from an upper edge thereof nearest the open end of the cavity for engaging a respective side of the blade terminal. A locking finger projects from the end wall of the terminal and is engageable with the locking ledge on the end wall of the terminal-receiving cavity.

According to one aspect of the invention, the dielectric housing includes a rear terminating face through which the terminal is inserted into the terminal-receiving cavity. Complementary interengaging abutting shoulders are provided between the terminal and the housing to define the depth of insertion of the terminal into the cavity. The abutting shoulders are between the one end wall of the terminal and the housing. As disclosed herein, the terminal includes a pair of the end walls each having an abutting shoulder engageable with a respective abutting shoulder on opposite end walls of the terminal-receiving cavity.

Other features of the invention including the terminal being stamped and formed of sheet metal material, and the flexible contact arms of the terminal being of thinner material than the side walls thereof. The terminal includes a plurality of terminating tails projecting from a lower edge of each side wall of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
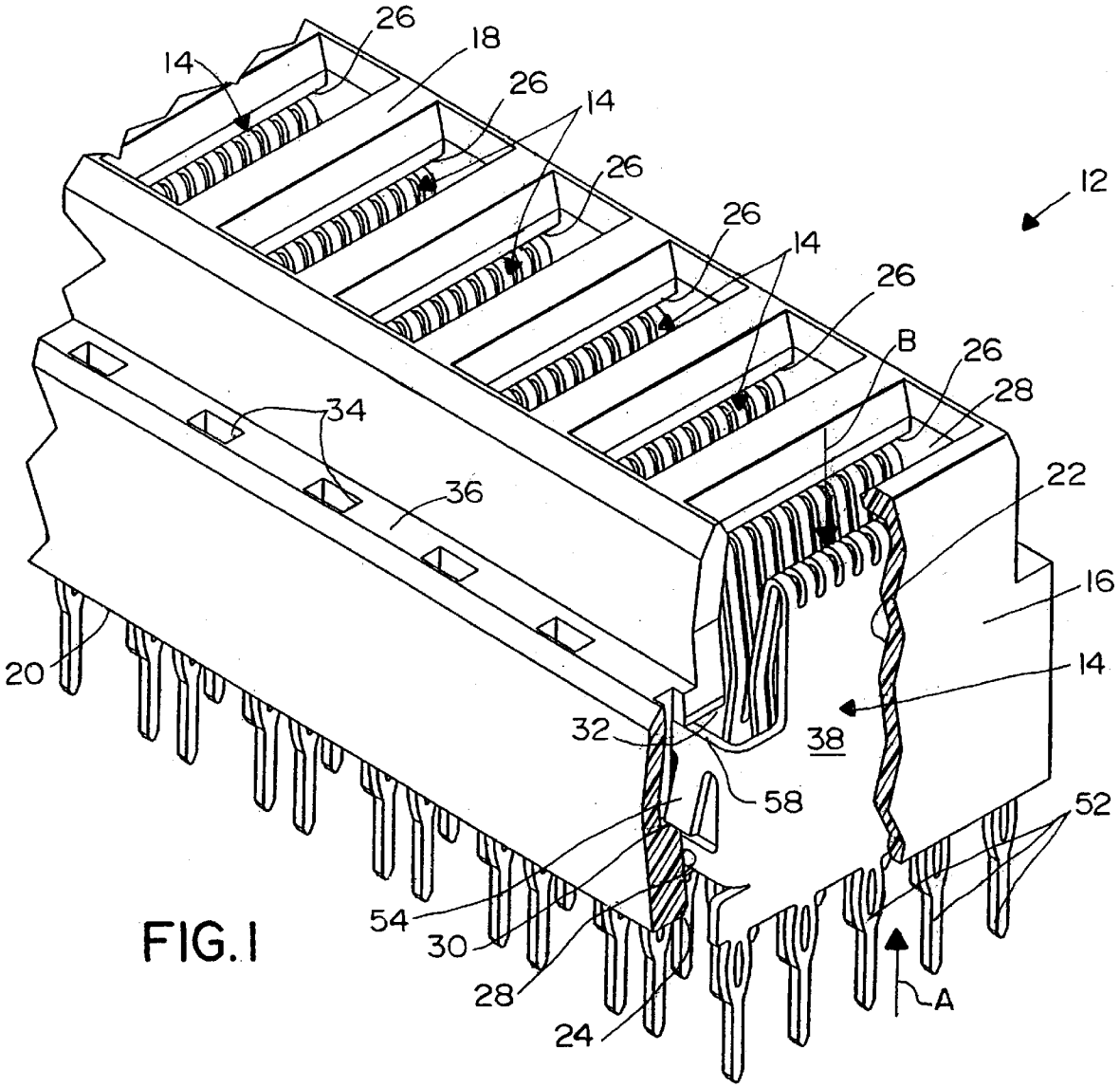
FIG. 1 is a fragmented, cut-away perspective view of an electrical connector embodying the concepts of the invention.

Referring to the drawings in greater detail, and first to FIG. 1, the invention is embodied in an electrical connector, generally designated 12, as well as in the configuration of a female terminal, generally designated 14, mounted in the connector. Generally, the connector and the terminal(s) are adapted for receiving and electrically engaging one or more terminal blades (not shown) from a power connector or other connecting device. Such a terminal blade simply is a flat member, typically of metal material, having opposite contact sides.

With that understanding, electrical connector 12 includes an insulative or dielectric housing 16 which may be a one-piece structure molded of plastic material or the like, for instance. The housing includes a front mating face 18 and a rear terminating face 20 which also may be a mounting face for mounting the connector on a printed circuit board. The housing has a plurality of elongated terminal-receiving cavities 22 for receiving terminals 14. Each cavity includes an open rear or bottom end 24 in terminating face 20 of the housing and into which a respective one of female terminals 14 is inserted in the direction of arrow "A". Each cavity includes an open top end 26 into which a mating blade terminal is inserted in the direction of arrow "B". Each cavity includes opposite end walls 28. Although FIG. 1 is broken away to show only one end wall 28 of one cavity 22, each end wall includes a locking ledge 30 and an abutment shoulder 32. Finally, holes 34 are provided through shoulder areas 36 of housing 16 for receiving appropriate core pins used to form locking ledges 30 during molding of the housing.

It can be seen in FIG. 1 that a plurality of open top ends 26 of the terminal-receiving cavities are provided in mating face 18 of connector housing 16 for receiving a ;plurality of terminal blades for electrical engagement with a plurality of female terminals 14 mounted in the connector housing. According to the invention, connector 12 may mount a single terminal 14 or a plurality of terminals, as shown. Therefore, a considerable portion of the following description will be directed to a single terminal 14 received in a single cavity 22, although it should be understood that the remaining cavities have constructions similar to that described above and the remaining terminals have constructions similar to that described below.

Figure 2:
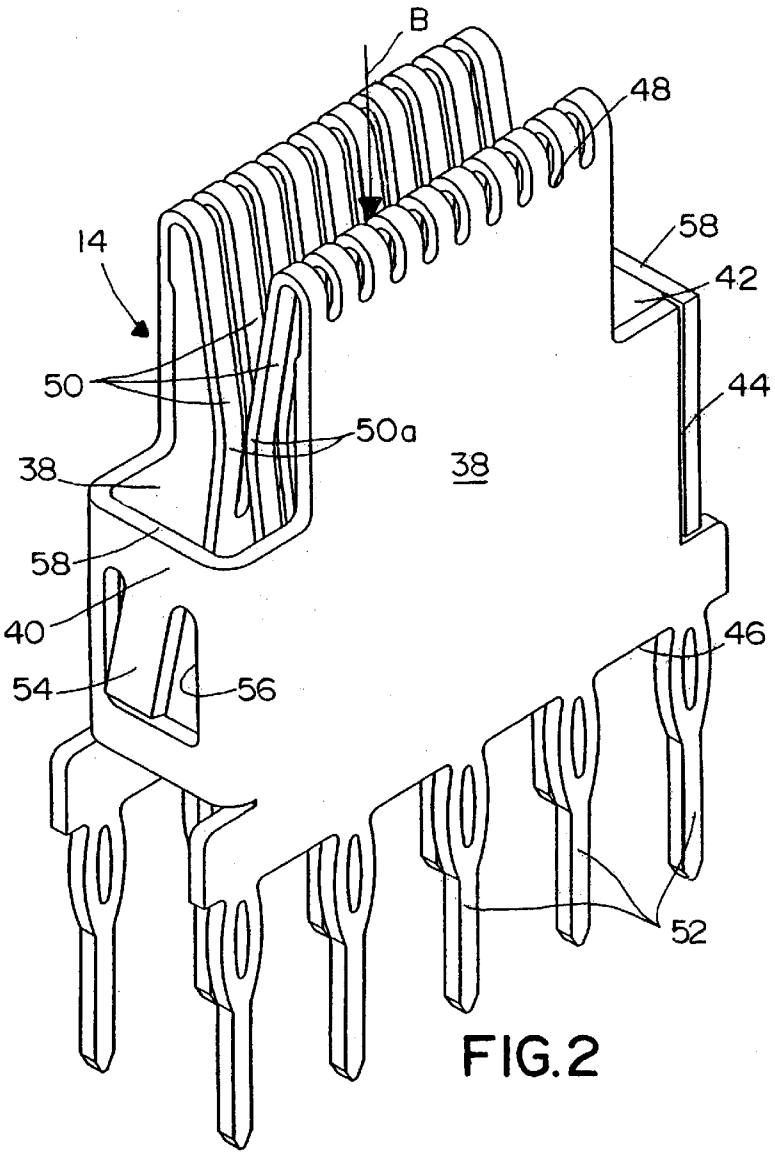
FIG. 2 is a perspective view of one of the female terminals according to the invention.
Figure 5:
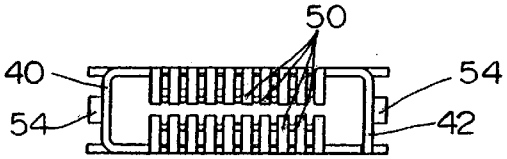
FIG. 5 is a top plan view of the female terminal.

With that understanding, reference is made FIGS. 2–5 in conjunction with FIG. 1, wherein a single female terminal 14 is shown for receiving a terminal blade in the direction of arrow "B" (FIG. 2). Each female terminal is stamped and formed of sheet metal material and includes a pair of elongated, planar side walls 38 and a pair of end walls 40 and 42. End wall 40 is integral with and joins side walls 38 and, in essence, defines the spacing of the side walls. End wall 42 spans the side walls, but a seam 44 is formed at a distal end of side wall 42 during the forming operation of the terminal. Each side wall 38 includes a lower edge 46 and an upper edge generally at 48. A plurality of contact arms 50 are folded back over each side wall 38 from upper edge 48 thereof. The contact arms are bowed to form opposing contact points 50a which engage opposite sides of the mating terminal blade. A plurality of terminating or solder tails 52 project from lower edge 46 of each side wall 38. The solder tails project beyond terminating face 20 of housing 16 as seen in FIG. 1, whereby the tails are insertable into appropriate holes in a printed circuit board for connection, as with a compliant pin or by soldering, to circuit traces on the board and/or in the holes.

Figure 3:
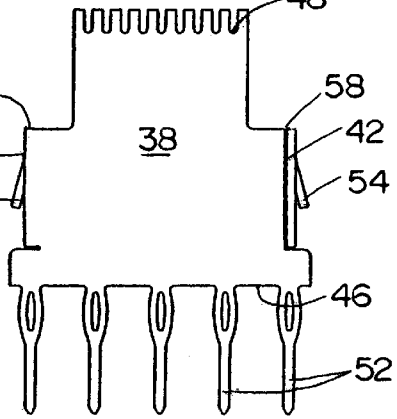
FIG. 3 is a side elevation view of the female terminal.
Figure 4:
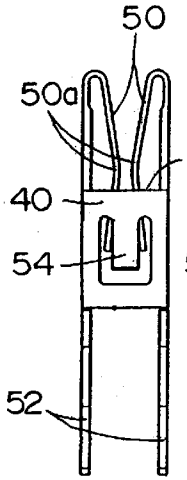
FIG. 4 is an end elevation view of the female terminal.
Figure 6B:
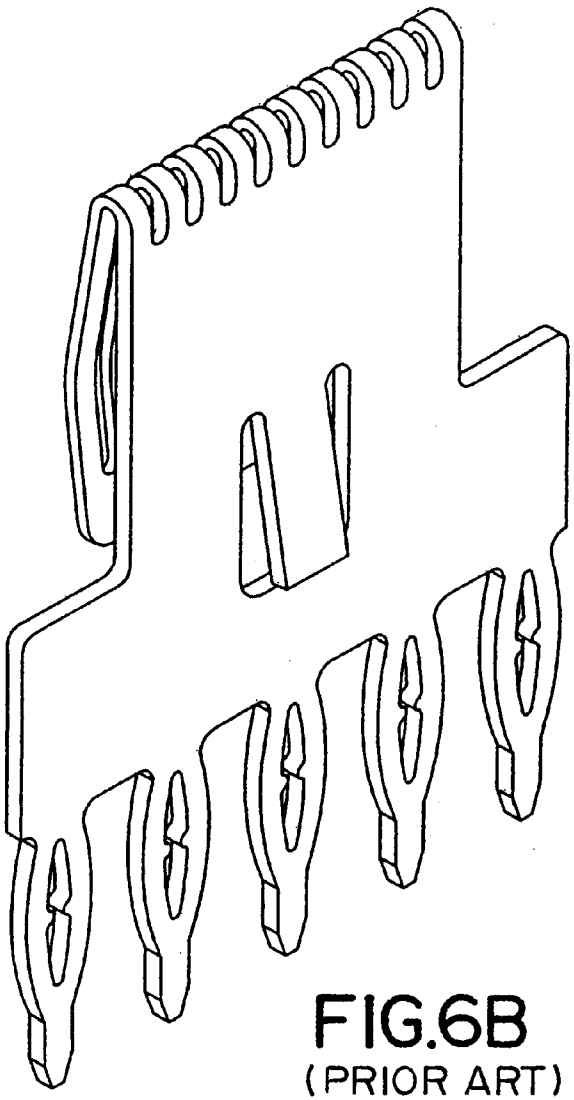
FIG.6B (PRIOR ART)
FIGS. 6*a* and 6*b* disclose a perspective view of two opposed female terminals in the prior art.
Figure 6A:
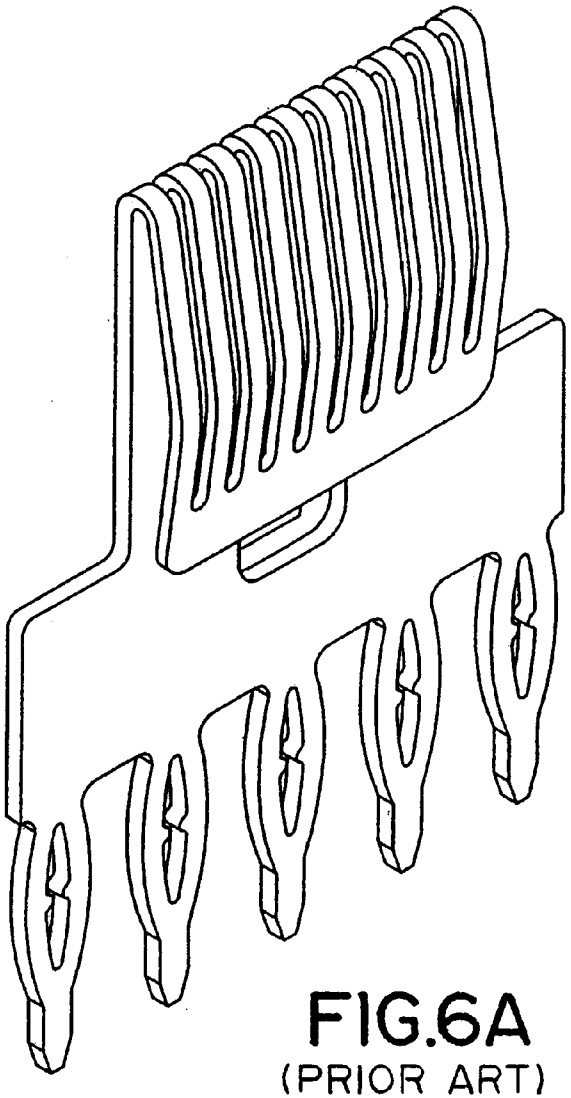
FIG.6A (PRIOR ART)

Generally, locking means are provided between end walls 40 and 42 of each terminal 14 and connector housing 16 to lock the terminal in its respective terminal-receiving cavity 22. More particularly, a locking finger 54 is stamped out of an opening 56 in each end wall 40 and 42 of the terminal. The locking fingers are bent outwardly from the end walls as best seen in FIG. 3, so that the locking fingers are angled outwardly and can be biased inwardly when the terminal is inserted into the housing. The locking fingers, therefore, are flexible and snap into engagement with locking ledges 30 (FIG. 1) formed on each end wall 28 of the respective terminal-receiving cavity 22. Locking fingers 54 and locking ledges 30 thereby lock the terminal in its respective cavity.

Generally, abutment means are provided between each female terminal 14 and housing 16 within the respective cavity 22 to define the specific depth of insertion of the terminal into its cavity. More particularly, it can be seen that contact arms 50 do not span the entire width of side walls 38 of the terminals. This leaves a top abutment edge 58 of each end wall 40 and 42 to define an abutment shoulder. Therefore, when terminal 14 is inserted into its cavity 22 in housing 16, abutment shoulders 58 at the top of end walls 40 and 42 of the terminal abuts against abutment shoulders 32 on end walls 28 of the cavity.

From the foregoing, it can be seen that both the locking means as well as the abutment means between female terminals 14 and connector housing 16 are provided at the end walls of the terminals and the end walls of the terminal-receiving cavities. Therefore, the cavities can be formed closer together lengthwise of the connector as viewed in FIG. 1 because extra plastic between the cavities is not needed to form the locking ledges. Instead, the locking ledges are at the ends of the cavities. In addition, coring does not have to be provided in relatively thin walls of the housing which define or separate the cavities as is prevalent in the prior art, where such means as locking or latching devices are provided in the side walls of the terminals. Also since the main current path is through the sidewall 38 between the contact arms 50 and the solder tails 52 and since the locking finger 54 is not punched from the side wall 38, the current path through the side wall is substantially improved. Finally, because the abutment edge 58 of each side wall engages a respective abutment shoulder 32 and because locking finger 54 of each side wall engages a respective locking ledge 30 at opposite ends of the terminal, the terminal is held in the housing more securely than the two separate terminals ensuring a more consistent distance and, accordingly, a more consistent force between opposed contact points 50a. Also, the larger two walled terminal is more easily inserted into the cavity as compared to the smaller singled walled terminal in the prior art.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

We claim:

1. An electrical connector for mating with a complementary connecting device having a blade terminal, comprising:

a dielectric housing having a front mating face, an elongated terminal receiving cavity with an open end through the mating face for insertion therethrough of said blade terminal, and a locking ledge on a first end wall of the cavity; and a conductive female terminal received in said cavity and including a pair of elongated side walls joined in spaced relation by at least one terminal end wall, a plurality of flexible contact arms folded back over each side wall from an upper edge thereof nearest the open end of the cavity for engaging a respective side of said blade terminal, a locking finger projecting from the at least one terminal end wall engageable with the locking ledge on the first end wall of the terminal-receiving cavity, and a plurality of terminating tails projecting from a lower edge of each side wall.

2. The electrical connector of claim 1 wherein said female terminal includes a second terminal end wall opposite said at least one terminal end wall and having a locking finger engageable with a locking ledge on a second end wall of the terminal-receiving cavity opposite said first end wall of the terminal-receiving cavity.

3. The electrical connector of claim 1 wherein said female terminal is stamped and formed of sheet metal material, and said flexible contact arms are of thinner material than said side walls of the female terminal.

4. The electrical connector of claim 1 wherein said dielectric housing includes a rear terminating face through which the female terminal is inserted into the terminal-receiving cavity.

5. The electrical connector of claim 4, including complementary interengaging abutting shoulders between the female terminal and the housing to define the depth of insertion of the female terminal into the cavity.

6. The electrical connector of claim 5 wherein said abutting shoulders are between the at least one terminal end wall and the housing.

7. The electrical connector of claim 6 wherein said female terminal includes a second terminal end wall opposite said at least one terminal end wall and having an abutting shoulder engageable with an abutting shoulder on a second end wall of the terminal-receiving cavity opposite said first end wall of the terminal-receiving cavity.

8. An electrical connector for mating with a complementary connecting device having a blade terminal, comprising:

a dielectric housing having a front mating face, a rear terminating face, an elongated terminal-receiving cavity with an open end through the mating face for insertion therethrough of said blade terminal, and a pair of opposite end walls of the cavity having respective locking ledges and abutment shoulders; and a conductive female terminal inserted into said cavity through the rear terminating face of the housing and including a pair of elongated side walls and a pair of end walls with at least one of the end walls joining the side walls in spaced relation, a plurality of flexible contact arms folded back over each side wall from an upper edge thereof nearest the open end of the cavity for engaging a respective side of said blade terminal, a locking finger projecting from each end wall of the female terminal and engageable with the locking ledge on a respective end wall of the terminal-receiving cavity, an abutment shoulder on each end wall of the female terminal engageable with the abutment shoulder on a respective end wall of the terminal-receiving cavity, and a plurality of terminating tails projecting from a lower edge of each side wall.

9. The electrical connector of claim 8 wherein said female terminal is stamped and formed of sheet metal material, and said flexible contact arms are of thinner material than said side walls of the female terminal.

10. A female terminal for insertion into a terminal-receiving cavity of an electrical connector housing and for receiving a mating blade terminal, the female terminal comprising:

a pair of elongated side walls joined in spaced relation by at least one terminal end wall, a plurality of flexible contact arms folded back over each side wall from an upper edge thereof for engaging a respective side of said blade terminal, a locking finger projecting from the at least one terminal end wall for engaging appropriate locking means in the cavity of the housing, an abutment shoulder on the at least one terminal end wall engageable with an appropriate abutment shoulder of the housing to define the depth of insertion of the female terminal into the cavity, and a plurality of terminating tails projecting from a lower edge of each side wall.

11. The female terminal of claim 10 including a second terminal end wall opposite said at least one terminal end wall and having a locking finger and an abutment shoulder.

12. The female terminal of claim 10 wherein said female terminal is stamped and formed of sheet metal material, and said flexible contact arms are of thinner material than said side walls of the female terminal.

* * * * *